US009354009B1

(12) United States Patent
Fidlow

(10) Patent No.: US 9,354,009 B1
(45) Date of Patent: May 31, 2016

(54) REMOTE CONTROLLED FIREARM SAFETY LOCKING SYSTEM

(71) Applicant: Hal Fidlow, Cranford, NJ (US)

(72) Inventor: Hal Fidlow, Cranford, NJ (US)

( * ) Notice: Subject to any disclaimer, the term of this patent is extended or adjusted under 35 U.S.C. 154(b) by 0 days.

(21) Appl. No.: 14/709,657

(22) Filed: May 12, 2015

(51) Int. Cl.
*F41A 17/00* (2006.01)
*F41A 17/06* (2006.01)

(52) U.S. Cl.
CPC ..... *F41A 17/06* (2013.01)

(58) Field of Classification Search
CPC ..... F41A 17/063; F41A 17/06
USPC ..... 42/70.01, 70.11
See application file for complete search history.

(56) References Cited

U.S. PATENT DOCUMENTS 2,846,925 A * 8/1958 Norman ..... F41A 17/38 42/25
7,937,880 B1 * 5/2011 Fidlow ..... F41A 17/06 396/426

* cited by examiner

*Primary Examiner* — Samir Abdosh
(74) *Attorney, Agent, or Firm* — Stuart M. Goldstein

(57) ABSTRACT

A remote controlled firearm safety system is provided for a "Glock" type handgun having a slide member, moveable over and along a muzzle section. The recoil spring guide assembly of the weapon, installed in the muzzle section, has a flange member with a plurality of socket openings. Each socket opening contains a locking pin which is moveable between a stored position within the socket openings and an extended position. When the locking pins are extended out of the socket openings, they extend partially into the muzzle section. This prevents the slide member from being cocked and the weapon from being fired. The movement of the locking pins is controlled by a signal receiving device within the recoil spring guide assembly. Upon receipt of a remote signal by the receiving device, a motor drive and a mechanical linkage are actuated to move the locking pins out of the socket openings.

4 Claims, 6 Drawing Sheets

REMOTE CONTROLLED FIREARM SAFETY LOCKING SYSTEM

BACKGROUND OF THE INVENTION

The use of firearms by local, state, and federal law enforcement personnel, as well as the military and private security sectors, presents a variety of situations in which the circumstances surrounding this usage becomes an issue. For instance, oftentimes there are serious questions as to whether the discharge of a weapon is necessary or Whether it is best that the weapon be disarmed to prevent it from being fired. Such circumstances may dictate that a weapon be disabled. By way of examples only, if the firearm should fall into the hands of unauthorized or dangerous individuals, if the weapon is lost or unaccounted for, or if it is not appropriate that the weapon be fired in a given situation, disabling that weapon, especially from a remote location, may not only be beneficial, but it also may be necessary in the interest of safety and even to save lives.

There are numerous s which have been proposed for locking or disabling a firearm from a remote location. These range from sending a signal to a weapon to prevent the operating of firing mechanics, to locking the trigger, to causing the user to drop the weapon when he or she receives an electric shock sent by remote signal. However, most of these systems are not practical or are very expensive to manufacture and install. Other such systems require additional, otherwise extraneous hardware which encumbers the firearm or makes it difficult to use. Most importantly, none of these prior remote locking systems can successfully and practically be utilized on existing components of firearms which employ a "Glock" type system of cocking, loading and firing.

SUMMARY OF THE INVENTION

It is thus an object of the present invention to provide a remote controlled firearm safety locking system which overcomes the disadvantages and limitations of existing firearm locking systems.

It is another object of the present invention to provide a remote controlled firearm safety locking system which will effectively disable a weapon from a remote location, as it may be necessary in the interest of safety and in order to prevent possible injury and death which would otherwise occur with a weapon which is armed.

It is still another object of the present invention to provide a remote controlled firearm safety locking system, specifically for a "Glock" type weapon, including a Glock Gen 4 and similar handguns.

It is a further object of the present invention to provide a remote controlled firearm safety locking system which can be configured within a modified recoil spring guide assembly, to replace the standard recoil spring guide assembly ordinarily used in the weapon.

It is another object of the present invention to provide a remote controlled firearm safety locking system which utilizes a modified recoil spring guide assembly which, upon its receipt of a remote signal, disables the weapon by preventing it from being cocked, loaded, and fired.

It is another object of the present invention to provide a remote controlled firearm safety locking system which can readily, practically, and relatively inexpensively modify an existing "Glock" type weapon.

These and other objects are accomplished by the present invention, a remote controlled firearm safety locking system for a "Glock" type handgun having a slide member, moveable over and along a muzzle section. The recoil spring guide assembly of the weapon, which is installed in the muzzle section, has a flange member with a plurality of socket openings. Each socket opening contains a locking pin which is moveable between a stored position within the socket opening and an extended position. When the locking pins are extended out of the socket openings, they extend partially into the muzzle section. This prevents the slide member from being cocked and the weapon from being fired. The movement of the locking pins is controlled by a signal receiving device within the recoil spring guide assembly. Upon receipt of a remote signal by the receiving device, a motor drive and mechanical linkage are actuated to move the locking pins out of the socket openings.

Novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
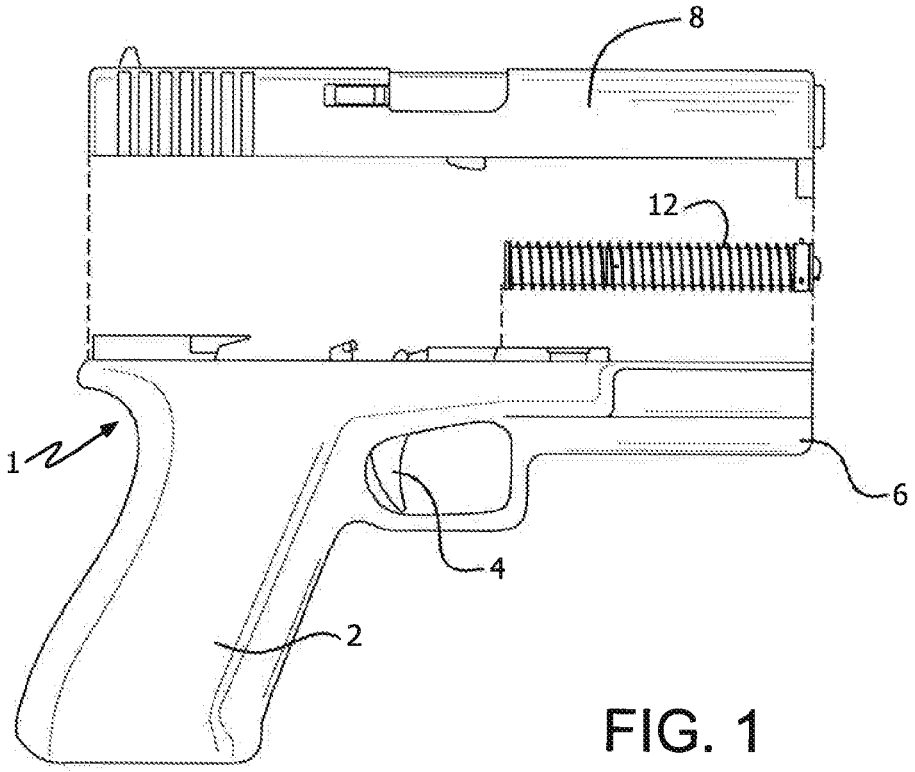
FIG. 1 is an exploded view of a handgun incorporating the remote controlled firearm safety locking system of the present invention.
Figure 2:
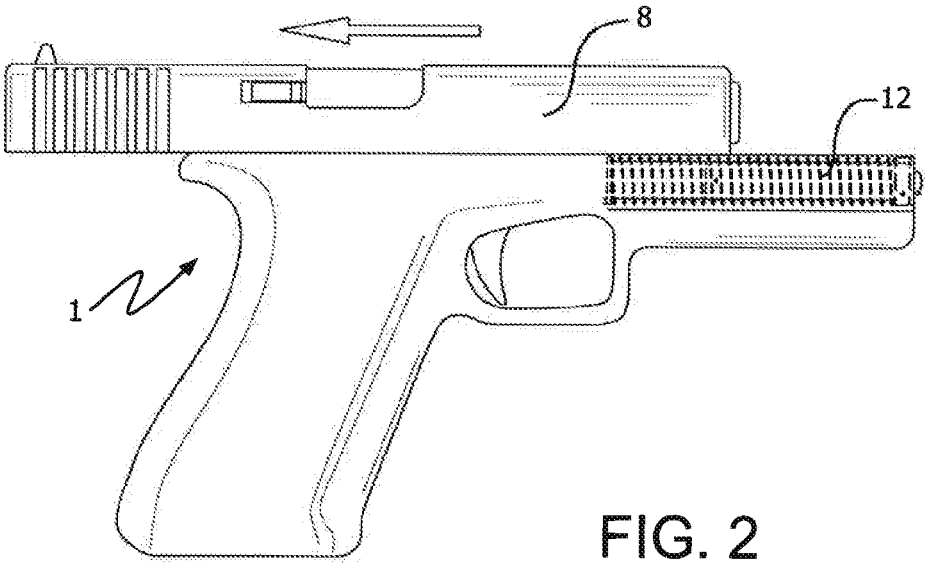
FIG. 2 is a side view of a handgun with the present invention, showing its slide member in a pre-cocked position.
Figure 3:
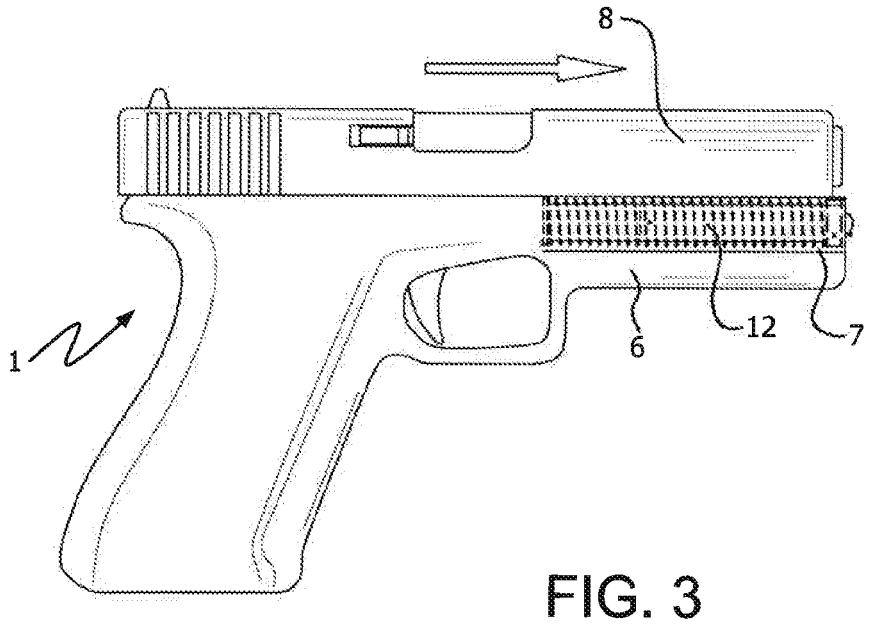
FIG. 3 is a side view of a handgun with the present invention showing its slide member being slid forward over and along the muzzle section.

Handgun 1, a Glock Gen 4 or similar "Glock" type handgun, comprises gun body 2 having trigger 4 and gun barrel or muzzle section 6 and slide member 8. Recoil spring guide assembly cavity 7 is located within muzzle section 6. As is standard in "Glock" type handguns, slide member 8 is configured to be slideably moveable over and along muzzle section 6 and gun body 2. In order to fire handgun 1, slide member 8 must be slid back and then pushed fully forward, over muzzle section 6. This ensures that handgun 1 is cocked, ready to load and upon pulling trigger 4, to be fired.

Recoil spring guide assembly 12 is configured to replace the standard recoil spring guide in muzzle section 6 of handgun 1. Assembly 12 comprises outer casing or housing 14. Casing 14 is optimally made of corrosion resistant steel or similar metal. Recoil spring 20 circumscribes housing 14. Recoil spring retention walls 16 and 18 of assembly 12 are located at the ends of casing 14. Raised notch 19 is provided on the back of rear wall 18. The notch indexes the slot in the receiver (not shown) in muzzle section 6 of gun 1, in order to maintain orientation of assembly 12.

Casing 14 is comprised of front section 22 and rear section 24. Sections 22 and 24 are threadably connected at 26 and secured with barrel locking screws 28. An O-ring spacer 29 provides a secure seal between sections 22 and 24. Rear section 24 comprises open space 30 in which battery 32, compelled against battery contact spring 34, is positioned.

Located within and forwardmost of front section 22 of casing 14 are the components of the camera integrated system, incorporated into recoil spring guide assembly 12. The system, the details of which are described in U.S. Pat. No. 7,937,880, includes a high speed camera with lens 38 extending through retention wall 16. Also positioned within section 22 are gunshot impact and switching module 40, camera control and memory module 42, and computer interface/battery powered connector 44. Power/data adapter 46, positioned between battery 32 and connector 44, provides connectivity of electrical power from the battery to the components located within front section 22.

Figure 8:
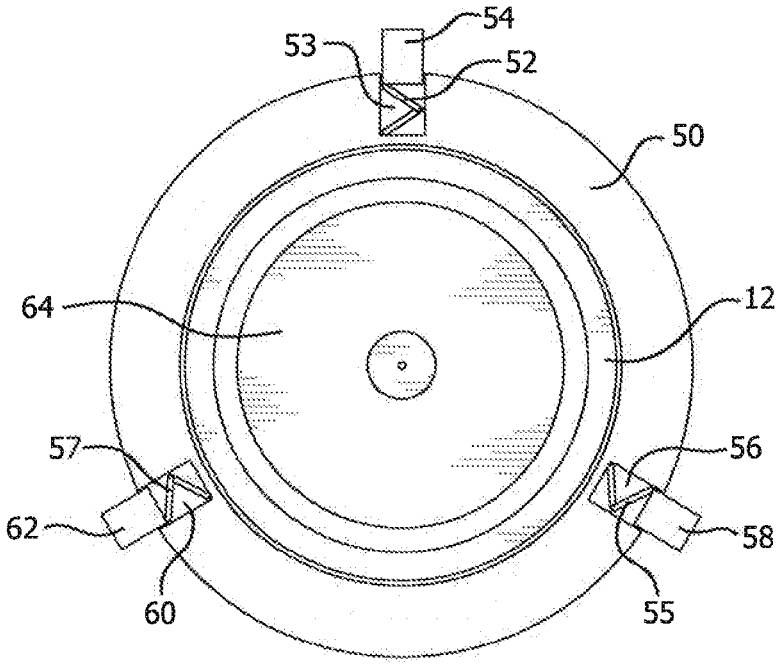
FIG. 8 is a cross-sectional view taken from FIG. 6 of the recoil spring guide assembly' of the present invention.
Figure 9:
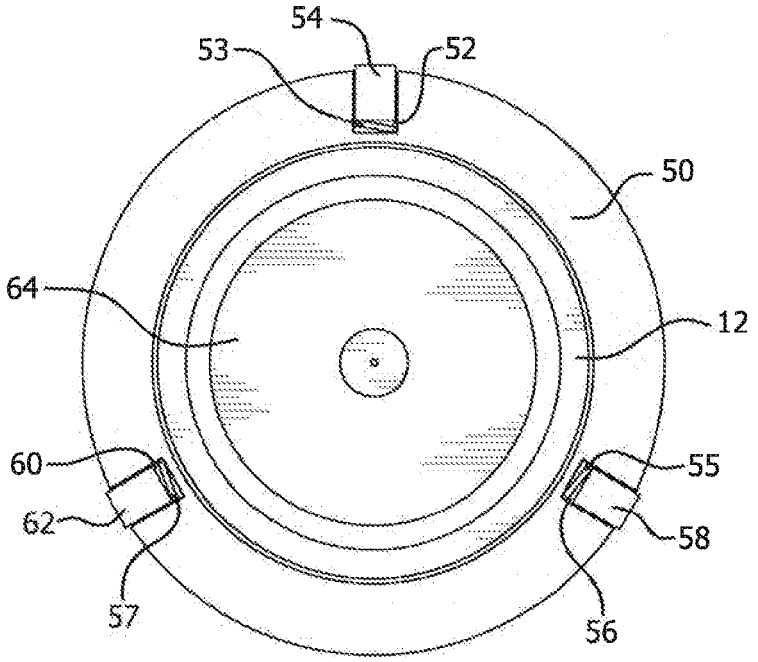
FIG. 9 is a view similar to FIG. 8, but with the locking pins in a stored position.

Also included in recoil spring assembly 12 and found around and in its casing 14, are the components of the safety locking system of the invention. Flange member 50, located at the forward end of front section 22, circumscribes casing 14. Flange 14 comprises a plurality of inset socket openings 52, 56, and 60. Locking pins 54, 58, and 62 are housed within the openings. The locking pins are moveable between a stored position, shown in FIG. 9, in which they are fully encased within openings 52, 56, and 60, and an extended position, shown in FIG. 8, wherein each locking pin 54, 58, and 62 is extended partially out of their respective openings, by means of linkages 53, 55, and 57, respectively.

Drive means 64, in the form of a motor drive and well-known mechanical connections, are located in casing 14. Drive means 64, once actuated, operates to move locking pins 54, 58, and 62 from their stored to extended positions and back to their stored positions.

Controller means 66 is also located within casing 14. It is a signal communication receiving device, e.g. a cellular or Bluetooth® transponder. Controller means 66 is configured to receive an outside signal designed to control the operation of drive means 64.

Battery 32 provides the electrical power, as necessary, for drive means 64 and controller means 66.

Figure 4:
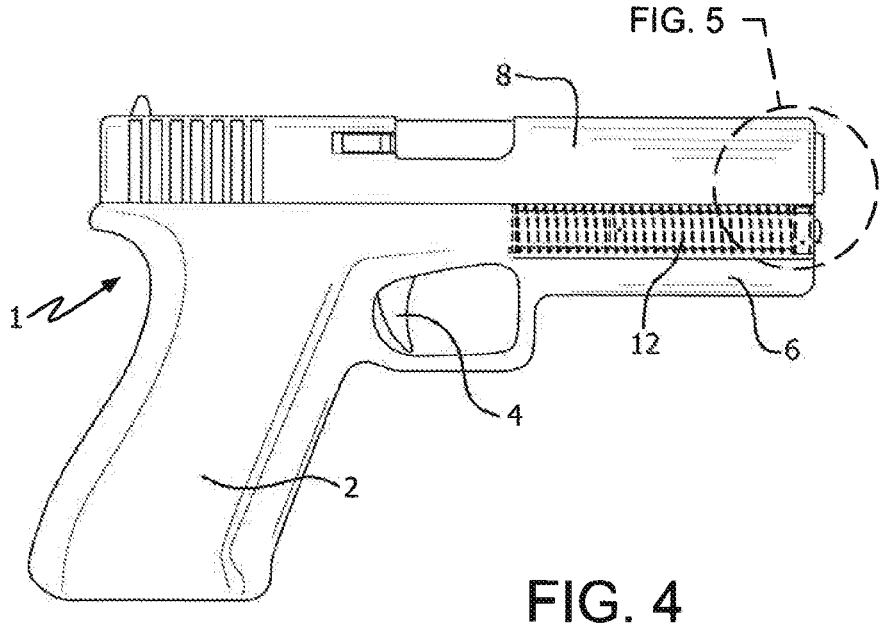
FIG. 4 is a side view of a handgun showing the present invention in the firing disabled position.
Figure 5:
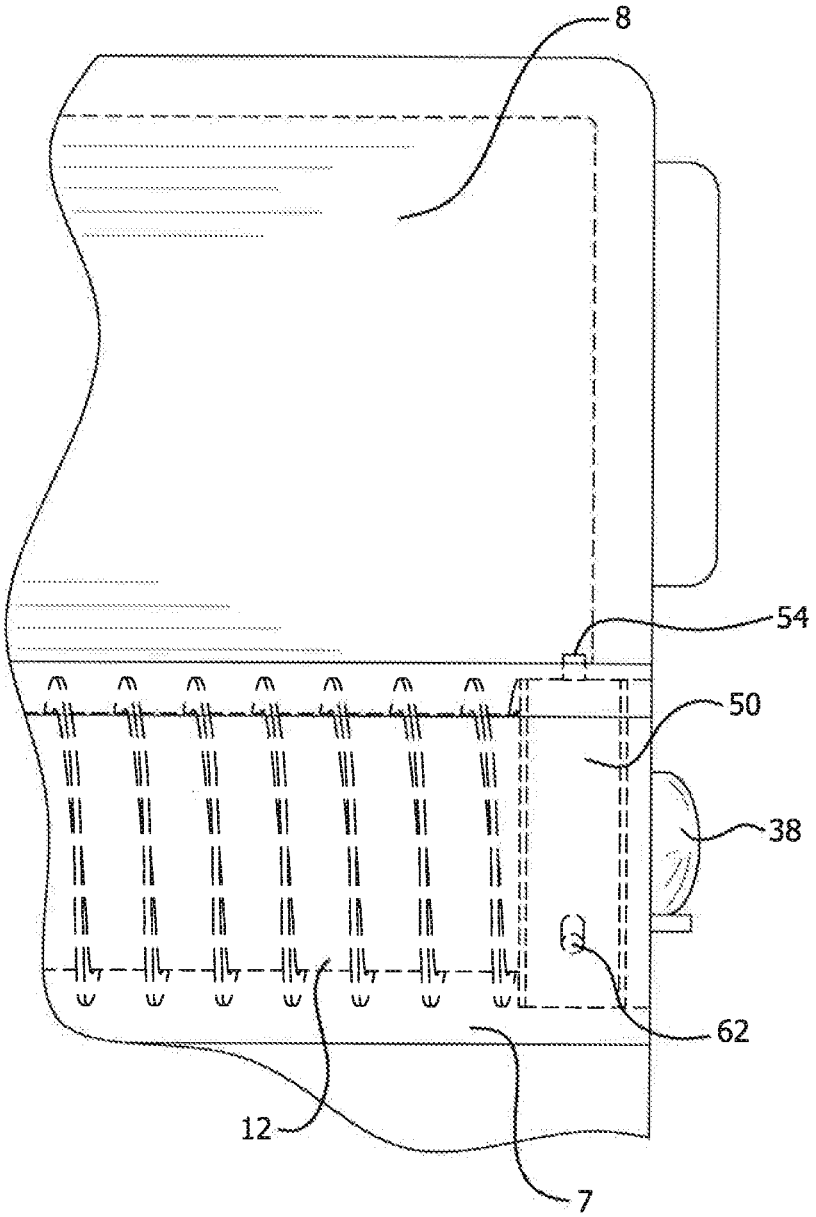
FIG. 5 is a detailed view taken from FIG. 4.
Figure 6:
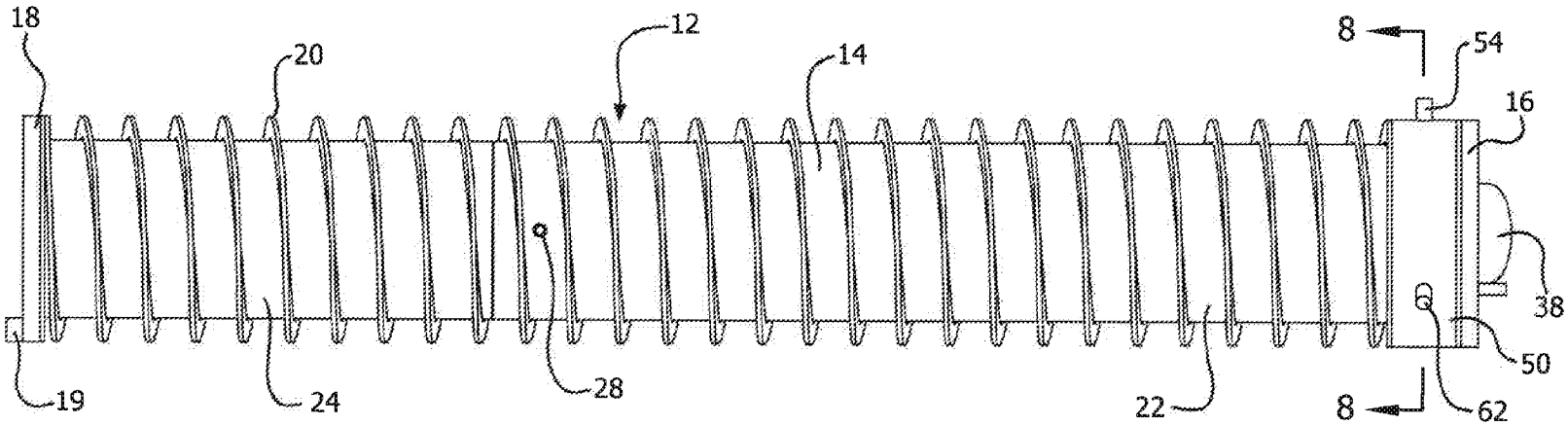
FIG. 6 is an elevation view of the recoil spring guide assembly of the present invention.
Figure 7:
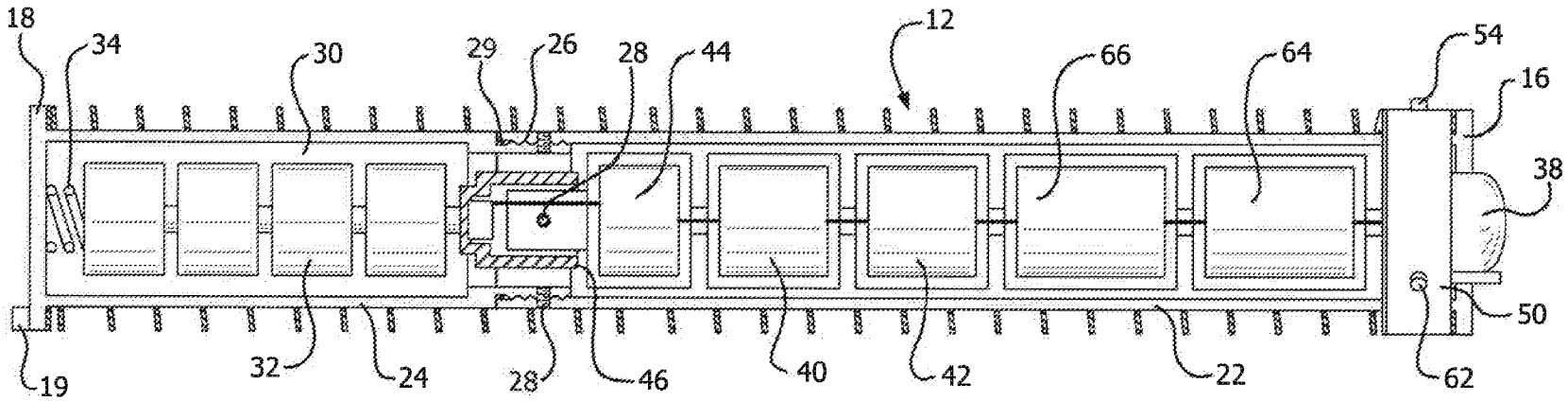
FIG. 7 is cross-sectional view of the recoil spring guide assembly of the present invention with its locking pins extended.

While slide member 8 can be slid back and then forward over and along muzzle section 6 and gun body 2, as shown in FIG. 24, when it is desired to disable handgun 1 in order to prevent it from being fired, the appropriate signal is transmitted to controller means 66 which communicates with and then actuates drive means 64. Drive means 64 operates to extend locking pins 54, 58, and 62 outward from their respective socket openings 52, 56, and 60. In their extended positions, locking pins 54, 58, and 62 are located within the path of travel of slide member 8, thus blocking the slide member, preventing it from being slid back over muzzle section 6, thus preventing handgun 1 from being cocked, as show in FIGS. 4 and 5. With slide member 8 in this locked position, held in place by pins 54, 58, and 62, handgun 1 cannot be fired.

Transmitting the appropriate signal to controller means 66 to again allow handgun 1 to be fired, reverses drive means 64 to retract locking pins 54, 58, and 62 back into their respective socket openings 52, 56, and 60. Slide member 8 is again free to be fully slid over muzzle section 6 and to properly cock handgun 1 for firing.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A remote controlled safety locking system for a firearm having a muzzle section, a slide member moveable over and along the muzzle section, and a recoil spring guide assembly cavity within the muzzle section, said system comprising:

an outer casing located within the recoil spring guide assembly cavity, said casing having a front section and a rear section;

a flange member located at the front section of the casing, said flange member comprising a plurality of socket openings, each socket opening containing a locking pin, said locking pins being moveable between a stored position within the socket opening and an extended position, wherein each locking pin extends at least partially out of the socket opening;

drive means located in the front section of the outer casing for moving the locking pins between the stored position and the extended position; and controller means for receiving a remote signal and for actuating the drive means, whereby upon receipt of the remote signal by the controller means, the drive means is actuated to extend the locking pins at least partially out of their respective sockets to prevent movement of the slide member along the muzzle section.

2. The safety locking system as in claim 1 further comprising means located within the outer casing to power the drive means and the controller means.

3. The safety locking system as in claim 1 wherein the controller means comprises a cellular or Bluetooth® transponder.

4. The safety locking system as in claim 1 wherein the drive means comprises a motor drive and mechanical connections.

* * * * *